US006978699B2

(12) United States Patent
Yuan-Chin et al.

(10) Patent No.: US 6,978,699 B2
(45) Date of Patent: Dec. 27, 2005

(54) RATCHET TOOL

(76) Inventors: Chi Yuan-Chin, 11F-2, No. 43, Da-Na Road, Taichung City (TW); Yang Pei-Chih, 4F, No. 357, Da-Na Road, Su-Lin, Taipei City (TW)

( * ) Notice: Subject to any disclaimer, the term of this patent is extended or adjusted under 35 U.S.C. 154(b) by 0 days.

(21) Appl. No.: 09/855,044

(22) Filed: May 15, 2001

(65) Prior Publication Data

US 2002/0170393 A1 Nov. 21, 2002

(51) Int. Cl.[7] ..... B25B 13/46
(52) U.S. Cl. ..... 81/58.5; 81/63.2
(58) Field of Search ..... 81/58.5, 60–63.2, 81/177.7

(56) References Cited

U.S. PATENT DOCUMENTS 1,113,248 A * 10/1914 Rice ..... 81/58
1,425,816 A * 8/1922 Van Horn ..... 81/58.5
1,435,111 A * 11/1922 Fetter ..... 81/58.5
1,670,547 A * 5/1928 North ..... 81/58.5
1,798,481 A * 3/1931 McNaught et al. ..... 74/145
1,798,482 A * 3/1931 McNaught et al. ..... 74/145
1,944,171 A * 1/1934 Daugherty ..... 81/58.5
2,704,479 A * 3/1955 Stang ..... 81/177.8

* cited by examiner

*Primary Examiner*—Joseph J. Hail, III
*Assistant Examiner*—David B. Thomas
(74) *Attorney, Agent, or Firm*—Charles E. Baxley

(57) ABSTRACT

A ratchet tool includes a ring-shaped head having a toothed member rotatably received therein and a first end of a handle is pivotally inserted in the ring-shaped head. A pawl is connected to the first end of the handle and pivotally engaged with the toothed member. Two springs are received in the ring-shaped head and contact two sides of the handle.

3 Claims, 5 Drawing Sheets

RATCHET TOOL

FIELD OF THE INVENTION

The present invention relates to a ratchet tool with simple structure and the tool is easily to be assembled.

BACKGROUND OF THE INVENTION

A conventional ratchet tool generally includes a ring-shaped head with a recess defined in an inner periphery of the head so as to receive a ratchet mechanism therein. The ratchet mechanism includes many parts and most of the parts have complicated shape. It takes a lot of time to assemble the ratchet tool and the head is required to have a large space to receive the mechanism so that the thickness of the head could be too large to be operated in a narrow space. Besides, most of the conventional ratchet tools do not expect to output large torque so that they are not necessarily to be equipped with complicated ratchet mechanism. The market needs a simple ratchet tool that is cheap and has limited functions.

The present invention intends to provide a ratchet tool that has simple structure and few parts.

SUMMARY OF THE INVENTION

In accordance with one aspect of the present invention, there is provided a ratchet tool and comprising a ring-shaped head with a toothed member rotatably received therein and a handle has a first end pivotally inserted in the ring-shaped head. A pawl is connected to the first end of the handle and pivotally engaged with the toothed member.

The primary object of the present invention is to provide a ratchet tool that has a handle pivotally connected to the ring-shaped head so as to pivot a pawl to engage with a toothed member in the ring-shaped head.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
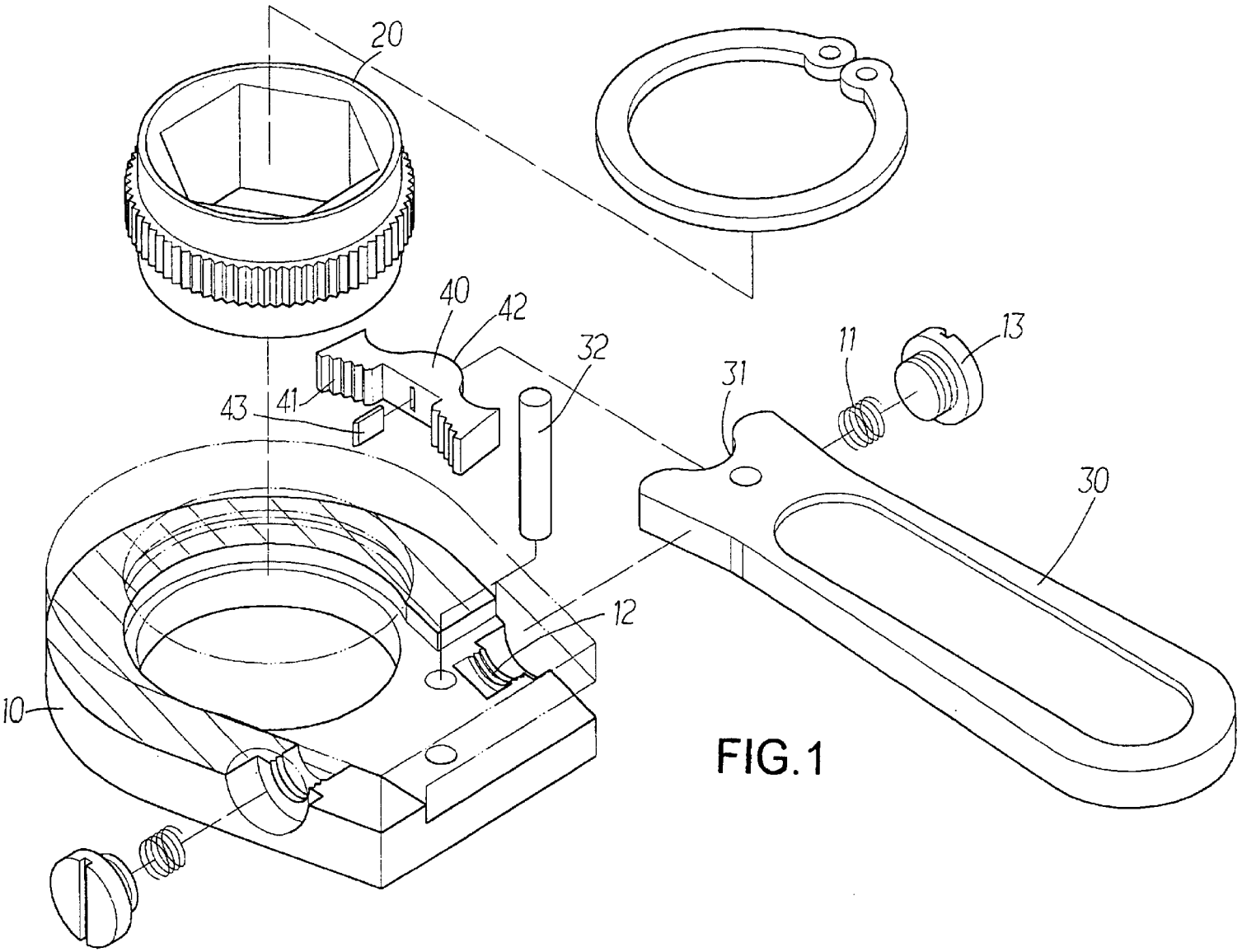
FIG. 1 is an exploded view to show a ratchet tool of the present invention.
Figure 2:
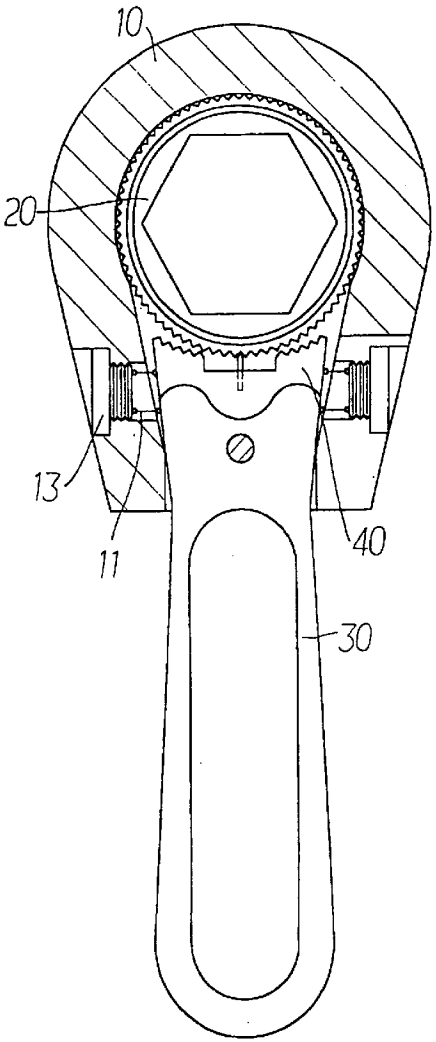
FIG. 2 is a plan view to show the handle is located in a neutral position relative to the head.

Referring to FIGS. 1 and 2, the ratchet tool of the present invention comprises a ring-shaped head 10 having a toothed member 20 rotatably received therein and the ring-shaped head 10 has an opening defined radially therein. A first end of a handle 30 is pivotally inserted in the opening of the ring-shaped head 10 by a pin 32. Two passages 12 are defined through the ring-shaped head 10 so as to receive two springs 11 therein. Two bolts 13 are threadedly engaged with the two passages 12 to retain the springs 11 in the passages 12. The two springs 11 contact two sides of the first end of the handle 30. A recess 31 is defined in the first end of the handle 30 so as to receive a pawl 40 therein. The pawl member 40 has two groups of teeth 41 defined in a first side thereof so as to be respectively engaged with the toothed member 20. A second side of the pawl 40 has a protrusion 42 extending from a second side of the pawl 40 so as to be engaged with the recess 31. A flexible plate 43 extends from the first side of the pawl 40 and contacts the toothed member 20.

The two springs 11 keep the handle 30 to be located at a neutral position relative to the head 10 and the tension of the springs 11 can be easily adjusted by rotating the two bolts 13.

Figure 3:
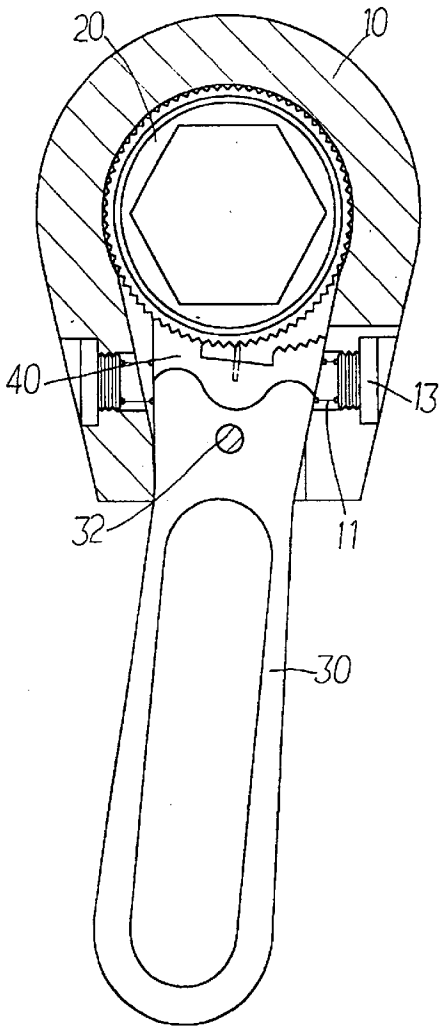
FIG. 3 is a plan view to show the handle is pivoted to a side to pivot the pawl to engage with the toothed member in the head of the ratchet tool.
Figure 4:
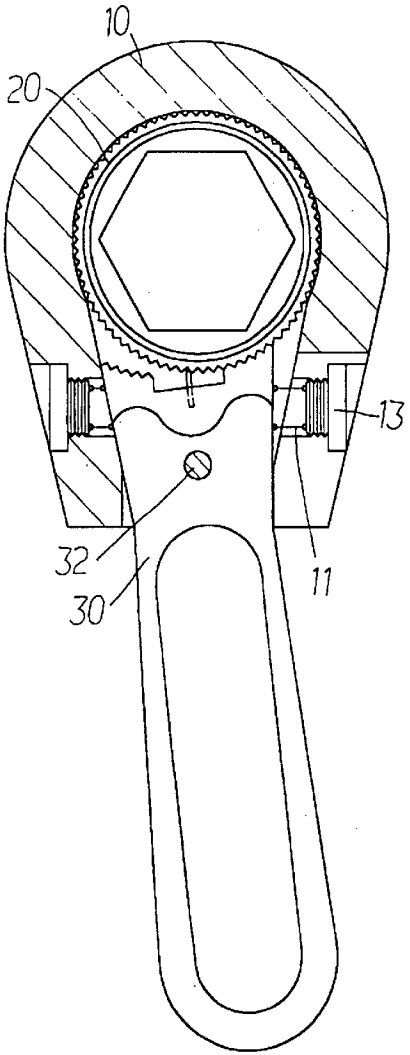
FIG. 4 is a plan view to show the handle is pivoted to the other side to pivot the pawl to engage with the toothed member in the head of the ratchet tool.

Referring to FIGS. 3 and 4, the handle 30 can be pivoted about the pin 32 so pivot the pawl 40 so as to let one group of teeth 41 be engaged with the toothed member 20. By this way to achieve the ratchet function. The flexible plate 43 moves over the teeth of the toothed member 20 to have "click" sound when rotating the handle 30 while the toothed member 20 is remained still.

Figure 5:
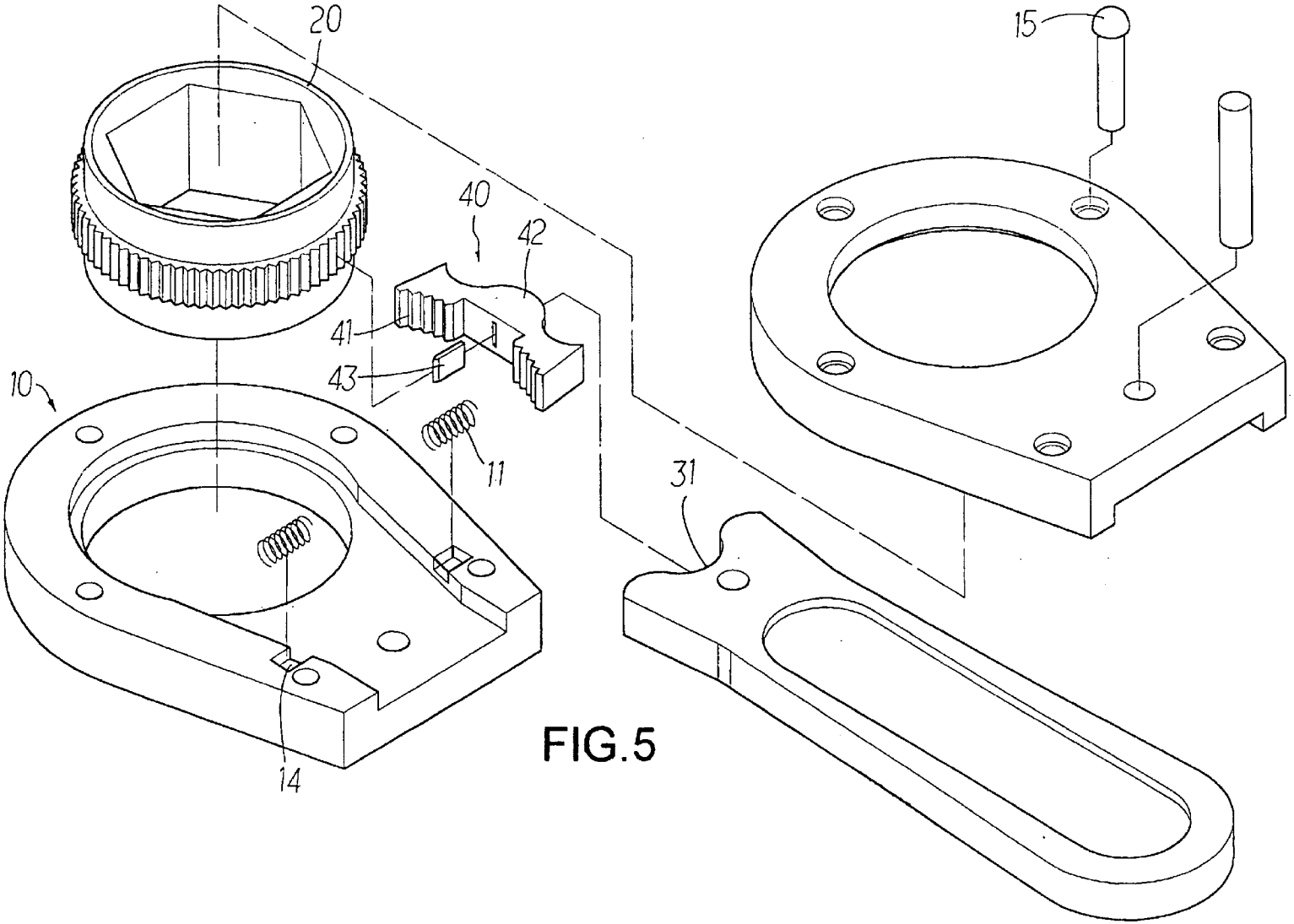
FIG. 5 is an exploded view to show another embodiment of the ratchet tool of the present invention.

FIG. 5 shows that the ring-shaped head 10 has two notches 14 defined in two opposite insides of the opening thereof so as to receive the two springs 11 therein. The ring-shaped head 10 is assembled by two halves by rivets 15.

Figure 6:
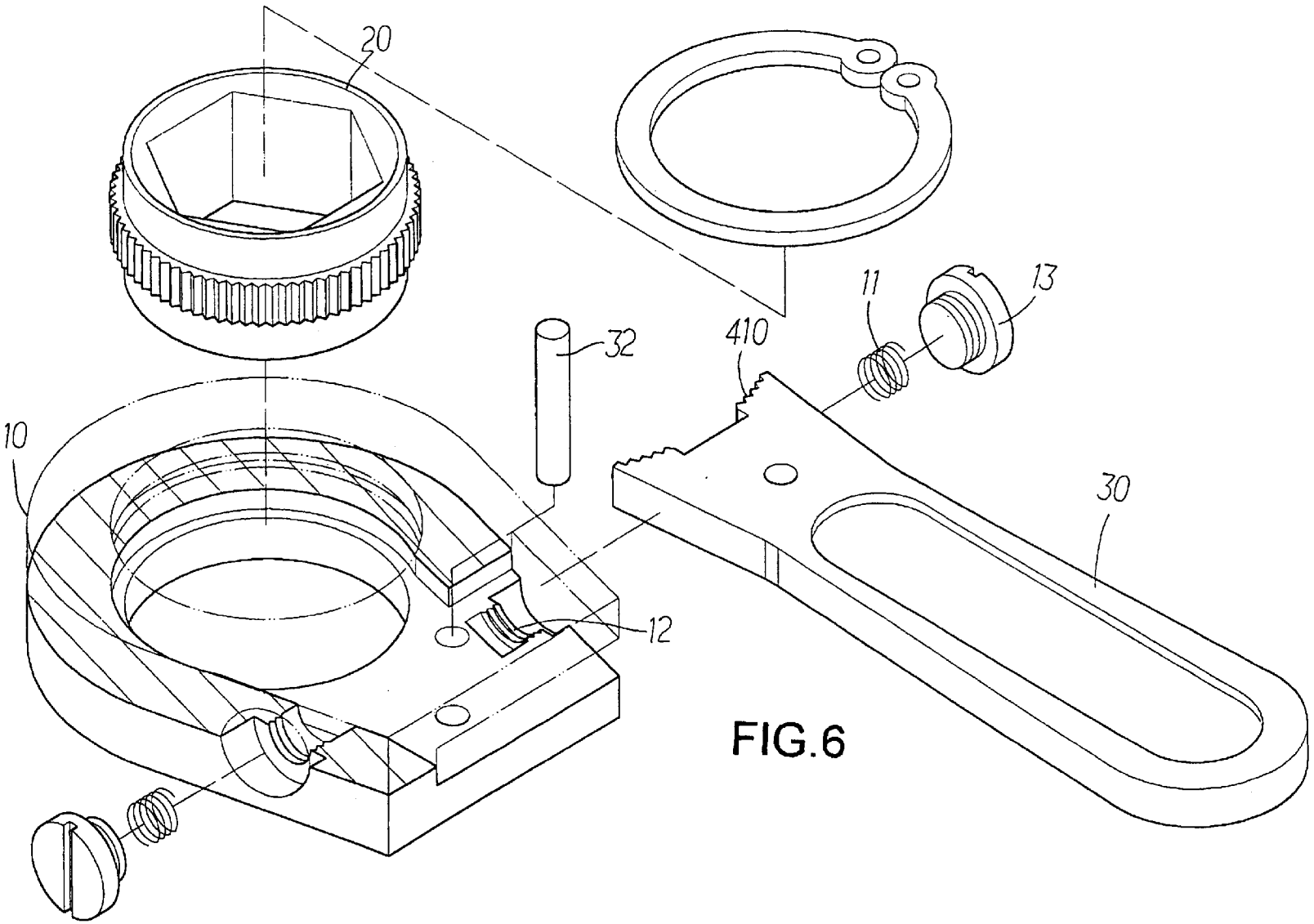
FIG. 6 is an exploded view to show yet another embodiment of the ratchet tool of the present invention.
Figure 9:
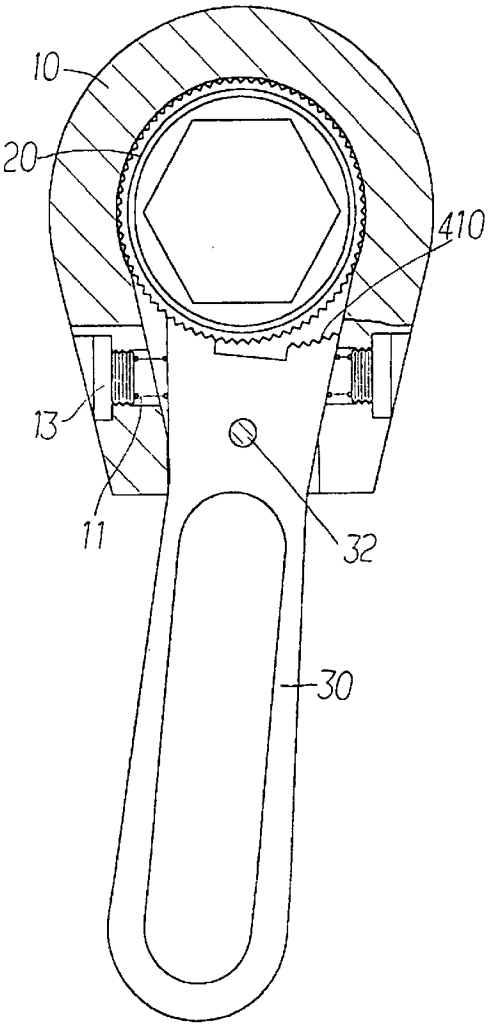
FIG. 9 is a plan view to show the handle is pivoted to the other side to pivot the pawl to engage with the toothed member in the head of the ratchet tool as shown in FIG. 6.
Figure 8:
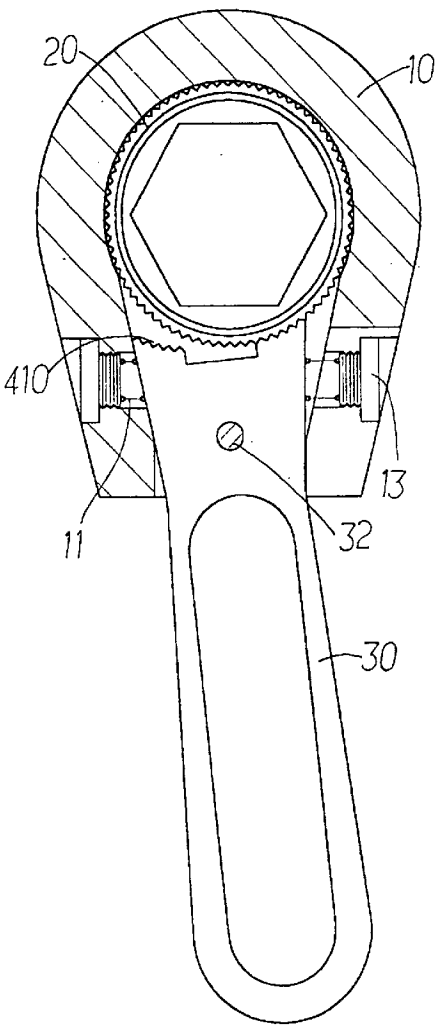
FIG. 8 is a plan view to show the handle is pivoted to a side to pivot the pawl to engage with the toothed member in the head of the ratchet tool as illustrated FIG. 6.
Figure 7:
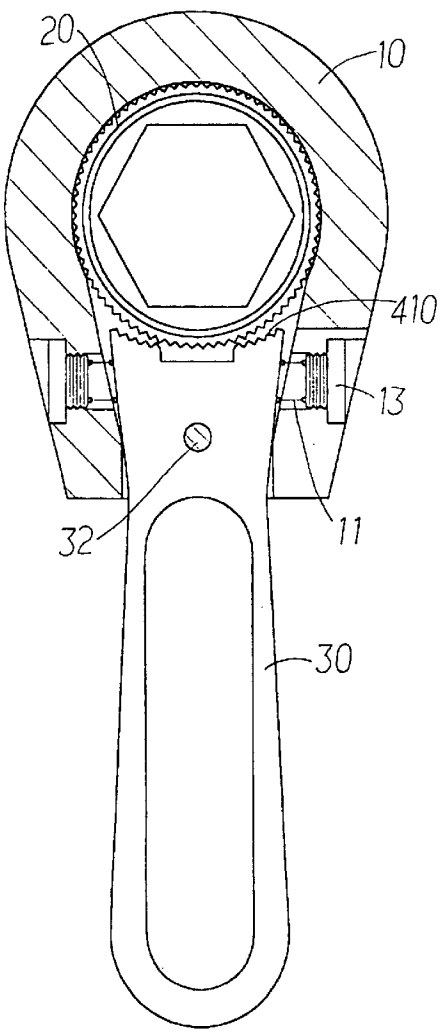
FIG. 7 is a plan view to show the handle is located in a neutral position relative to the head of the tool as illustrated in FIG. 6.

FIG. 6 shows that the pawl 40 as illustrated in FIG. 1 can be made with the handle 30 as a one-piece member. In other words, the first end of the handle 30 has two protrusion portions and each of which has teeth 410 for being engaged with the toothed member 20. FIGS. 7 to 9 shows the handle 30 as shown in FIG. 6 is pivoted to its three positions when operating the ratchet tool.

The ratchet tool of the present invention comprises only few parts and is easily to be assembled.

While we have shown and described various embodiments in accordance with the present invention, it should be clear to those skilled in the art that further embodiments may be made without departing from the scope of the present invention.

What is claimed is:

1. A ratchet tool comprising:

a ring-shaped head having a toothed member rotatably received therein and a handle having a first end pivotally inserted in said ring-shaped head, a recess defined in said first end of said handle, and a pawl located in said ring-shaped head and between said handle and said toothed member, said pawl having teeth defined in a first side thereof so as to be engaged with said toothed member, a flexible plate extending from said first side of said pawl and contacting said toothed member, a protrusion extending from a second side of said pawl and engaged with said recess in said first end of said handle.

2. The ratchet tool as claimed in claim 1 further comprising two springs received in said ring-shaped head and located on two sides of said first end of said handle.

3. The ratchet tool as claimed in claim 2 further comprising two passages defined through said ring-shaped head and said two springs respectively received in said two passages, two bolts engaged with said two passages to retain said springs in said passages.

* * * * *